United States Patent [19]

Oda et al.

[11] Patent Number: 4,741,302

[45] Date of Patent: May 3, 1988

[54] INTERNAL COMBUSTION ENGINE

[75] Inventors: Hiroyuki Oda; Akira Kageyama; Yasuyuki Morita, all of Hiroshima, Japan

[73] Assignee: Mazda Motor Corporation, Japan

[21] Appl. No.: 804,839

[22] Filed: Dec. 5, 1985

[30] Foreign Application Priority Data

| | | | |
|---|---|---|---|
| Dec. 10, 1984 | [JP] | Japan | 59-261334 |
| Dec. 10, 1984 | [JP] | Japan | 59-261337 |
| Dec. 14, 1984 | [JP] | Japan | 59-265084 |
| Jan. 8, 1985 | [JP] | Japan | 60-1823 |

[51] Int. Cl.[4] ..... F01L 1/26

[52] U.S. Cl. ..... 123/90.23; 123/90.27; 123/90.44; 123/308; 123/315; 123/432

[58] Field of Search ..... 123/90.44, 90.27, 90.22, 123/90.23, 308, 315, 432

[56] References Cited

U.S. PATENT DOCUMENTS

| | | | |
|---|---|---|---|
| 4,519,364 | 5/1985 | Enomoto et al. | 123/90.27 |
| 4,553,515 | 11/1985 | King et al. | 123/90.27 |
| 4,558,667 | 12/1985 | Inagaki et al. | 123/90.44 |

FOREIGN PATENT DOCUMENTS

| | | | |
|---|---|---|---|
| 144179 | 6/1985 | European Pat. Off. . | |
| 871221 | 2/1953 | Fed. Rep. of Germany . | |
| 1292444 | 8/1966 | Fed. Rep. of Germany . | |
| 1426103 | 12/1968 | Fed. Rep. of Germany . | |
| 2919213 | 11/1980 | Fed. Rep. of Germany | 123/90.27 |
| 1215450 | 4/1960 | France . | |
| 43228 | 3/1980 | Japan | 123/90.27 |
| 102506 | 6/1982 | Japan . | |
| 35106 | 2/1985 | Japan | 123/90.44 |
| 431144 | 7/1935 | United Kingdom . | |
| 456688 | 11/1936 | United Kingdom . | |
| 2016084 | 9/1979 | United Kingdom . | |

*Primary Examiner*—Ira S. Lazarus

*Attorney, Agent, or Firm*—Gerald J. Ferguson, Jr.; Michael P. Hoffman; Michael J. Foycik, Jr.

[57] ABSTRACT

In a four-valve engine having a pair of intake ports and a pair of exhaust ports, the hole for inserting the spark plug or the fuel injection nozzle is obliquely formed between the exhaust ports so that one end of the hole opens in the lower surface of the cylinder head at the center of the combustion chamber and the other end of the hole opens between the spring seat portions for the exhaust valve springs and the opening of the exhaust ports in the side face of the cylinder head.

9 Claims, 8 Drawing Sheets

INTERNAL COMBUSTION ENGINE

BACKGROUND OF THE INVENTION

1. Field of the Invention

This invention relates to an internal combustion engine, and more particularly to an internal combustion engine having a pair of intake valves and a pair of exhaust valves for each cylinder.

2. Description of the Prior Art

There has been put into practice an internal combustion engine in which each cylinder is provided with a pair of intake valves and a pair of exhaust ports in order to improve the volumetric efficiency and the scavenging efficiency, thereby improving combustion in the combustion chamber and increasing the engine output power. Such an engine having a pair of intake valves and a pair of exhaust valves will be referred to as "four-valve engine", hereinbelow. The four-valve engine, however, involves the following difficulties. That is, since four valves must be driven for each combustion chamber in the four-valve engine, the space around the cylinder head is crowded and accordingly, difficulties arises regarding the position of the spark plug (the fuel injection nozzle in the case of a diesel engine). In order to obtain good ignition of the air-fuel mixture and good propagation of flame in the combustion chamber, the spark plug or the fuel injection nozzle should be centrally located in the combustion chamber. A particular problem is that in the case of a single overhead camshaft four-valve engine in which the overhead camshaft is centered over the combustion chambers, mounting and demounting of the spark plug or the fuel injection nozzle is interfered with by the overhead camshaft.

In Japanese Unexamined Patent Publication No. 57(1982)-102506, there is disclosed a single overhead camshaft four-valve engine in which the spark plug is obliquely supported on the exhaust port side on which a relatively large amount of room remains and only the igniting tip is centrally located in the combustion chamber. As shown in FIGS. 10 and 11, the engine has a pair of intake valves 2 and a pair of exhaust valves 3 for each combustion chamber 1, the intake valves 2 and the exhaust valves 3 being arranged at the respective corners of a rectangle. A single overhead camshaft 4 is centrally positioned over the combustion chamber 1. A spark plug 5 is obliquely disposed between the exhaust valves 3 so that its igniting tip 5*a* is centrally located in the combustion chamber 1 and its upper end 5*b* is directed obliquely upward beside the camshaft 4. This arrangement permits the igniting tip 5*a* of the spark plug 5 to be centrally located in the combustion chamber 1 so as to obtain good ignition of the air-fuel mixture, and prevents interference of the spark plug 5 with the camshaft 4. However, with this arrangement, the rocker arm shaft 7 for pivotally supporting the rocker arms 6 for driving the exhaust valves 3 in response to rotation of the camshaft 4 must be separated for each rocker arm 6 in order to give access to the spark plug 5 because, if the rocker arms 6 are supported on a single shaft, the upper end 5*b* of the spark plug 5 extending substantially in parallel to the valve stems of the exhaust valves 3 is positioned immediately below the rocker arm shaft between the rocker arms 6 for each combustion chamber 1 so that the rocker arm shaft interferes with mounting and demounting of the spark plug 5. Therefore, a pair of rocker arm shafts are required for each combustion chamber. This significantly complicates the structure for mounting the rocker arm shafts especially in the case of a multiple cylinder engine.

SUMMARY OF THE INVENTION

In view of the foregoing observations and description, the primary object of the present invention is to provide a four-valve engine in which the tip of the spark plug or the fuel injection nozzle can be centrally located in the combustion chamber in a manner which permits the spark plug or the fuel injection nozzle to be easily mounted or demounted without complicating the structure of the valve driving mechanism.

In the four-valve engine in accordance with the present invention, the hole for inserting the spark plug or the fuel injection nozzle is obliquely formed between the exhaust ports so that one end of the hole opens in the lower surface of the cylinder head at the center of the combustion chamber and the other end of the hole opens between the spring seat portions for the exhaust valve springs and the opening of the exhaust ports in the side face of the cylinder head.

With this arrangement, the tip of the spark plug or the fuel injection nozzle is centrally located in the combustion chamber and the upper end of the same is directed obliquely upward on the outer side of the spring seat portion when the spark plug or the fuel injection nozzle is inserted into the hole. Therefore, good ignition of the air-fuel mixture and good propagation of flame can be ensured and at the same time, the spark plug or the fuel injection nozzle can be mounted and demounted without interference with the valve driving mechanism. Further, such effects can be obtained without complicating the structure.

DESCRIPTION OF THE PREFERRED EMBODIMENTS

Figure 1:
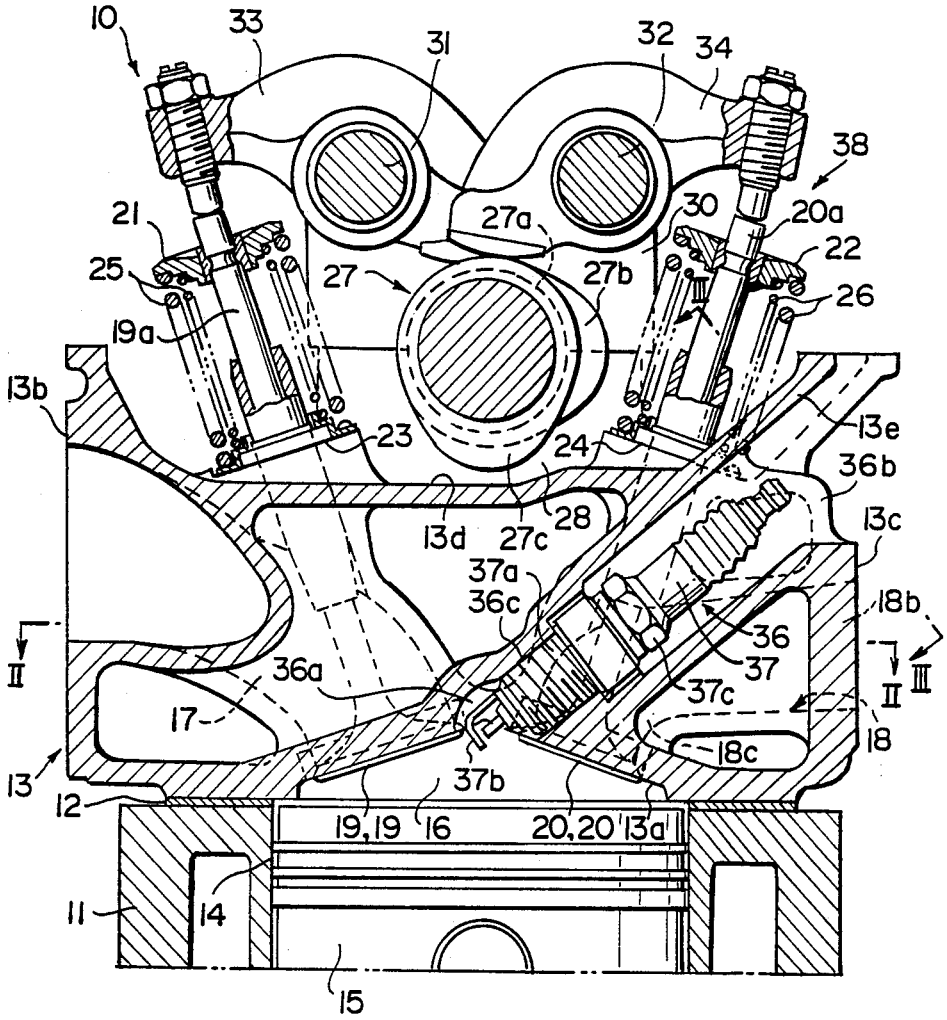
FIG. 1 is a fragmentary cross-sectional view of a single overhead camshaft four-valve engine in accordance with an embodiment of the present invention.
Figure 2:
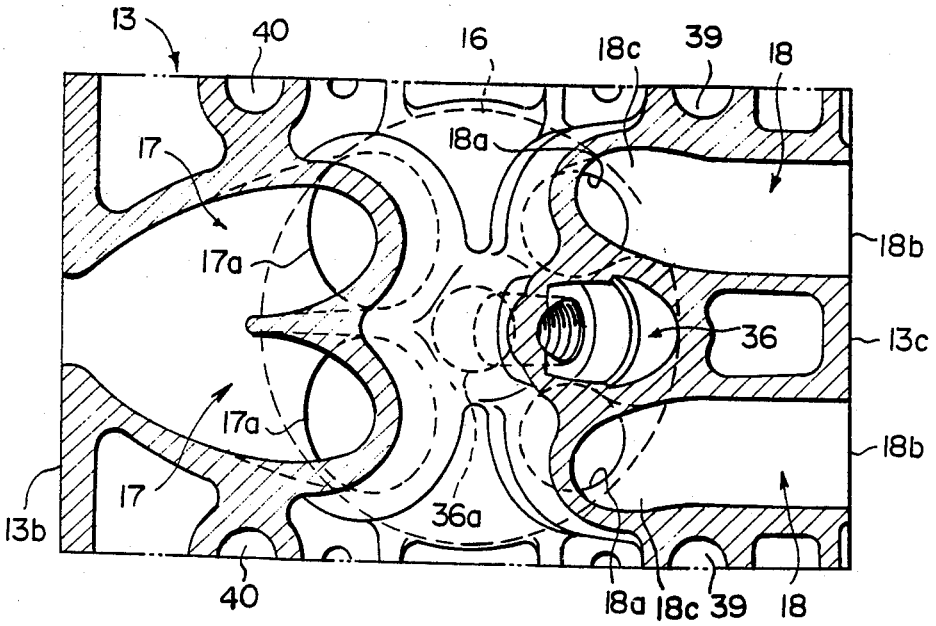
FIG. 2 is a cross-sectional view taken along line II—II in FIG. 1.
Figure 3:
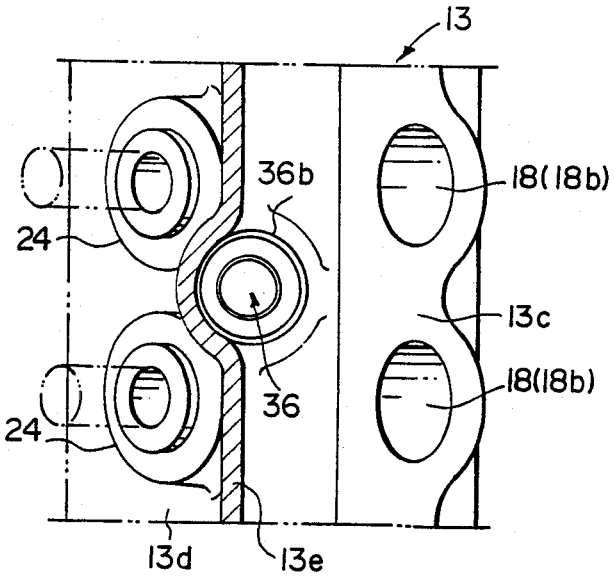
FIG. 3 is a cross-sectional view taken along line III—III in FIG. 1.

In FIGS. 1 to 3, a single-overhead-camshaft engine 10 in accordance with an embodiment of the present invention comprises a cylinder block 11 having a plurality of cylinders 14 arranged in line, and a cylinder head 13 mounted on the cylinder block 11 with a gasket 12 intervening therebetween. The inner surface of each cylinder 14, the top surface of the piston 15 received in the cylinder 14 and a recessed portion 13*a* formed in the lower surface of the cylinder head 13 opposed to each cylinder 14 define a combustion chamber 16. Each of the combustion chambers 16 is provided with a pair of intake ports 17 leading to the combustion chamber 16 from one side 13*b* of the cylinder head 13, and a pair of exhaust ports 18 leading to the combustion chamber 16 from the other side 13*c* of the cylinder head 13. The ends 17*a* and 18*a* of the intake and exhaust ports 17 and 18 for each combustion chamber 16 opening in the recessed portion 13*a* of the cylinder head 13 are arranged at the respective corners of a rectangle. The intake ports 17 and the exhaust ports 18 are provided with intake valves 19 and exhaust valves 20. The stems 19*a* of the intake valves 19 and the stems 20*a* of the exhaust valves 20 extend upward and project from the upper surface 13*d* of the cylinder head 13. Each of the intake valves 19 is urged toward the closed position by a valve spring 25 compressed between a spring retainer 21 and a spring seat portion 23 formed in the upper surface 13*d* of the cylinder head 13 at a portion through which the valve stem 19*a* projects. Similarly, each of the exhaust valves 20 is urged toward the closed position by a valve spring 26 compressed between a spring retainer 22 and a spring seat portion 24 formed in the upper surface 13*d* of the cylinder head 13 at a portion through which the valve stem 20*a* projects.

Figure 5:
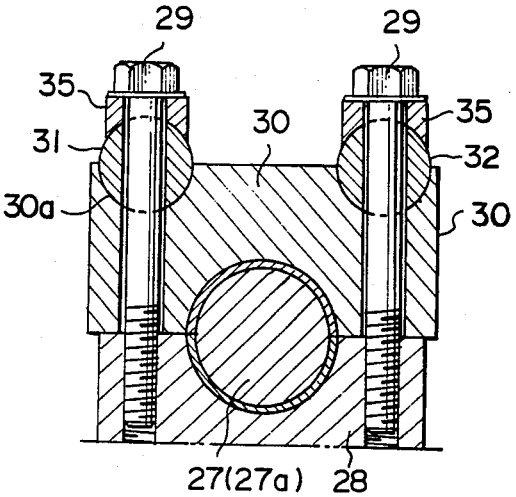
FIG. 5 is a cross-sectional view taken along line V—V in FIG. 4.
Figure 4:
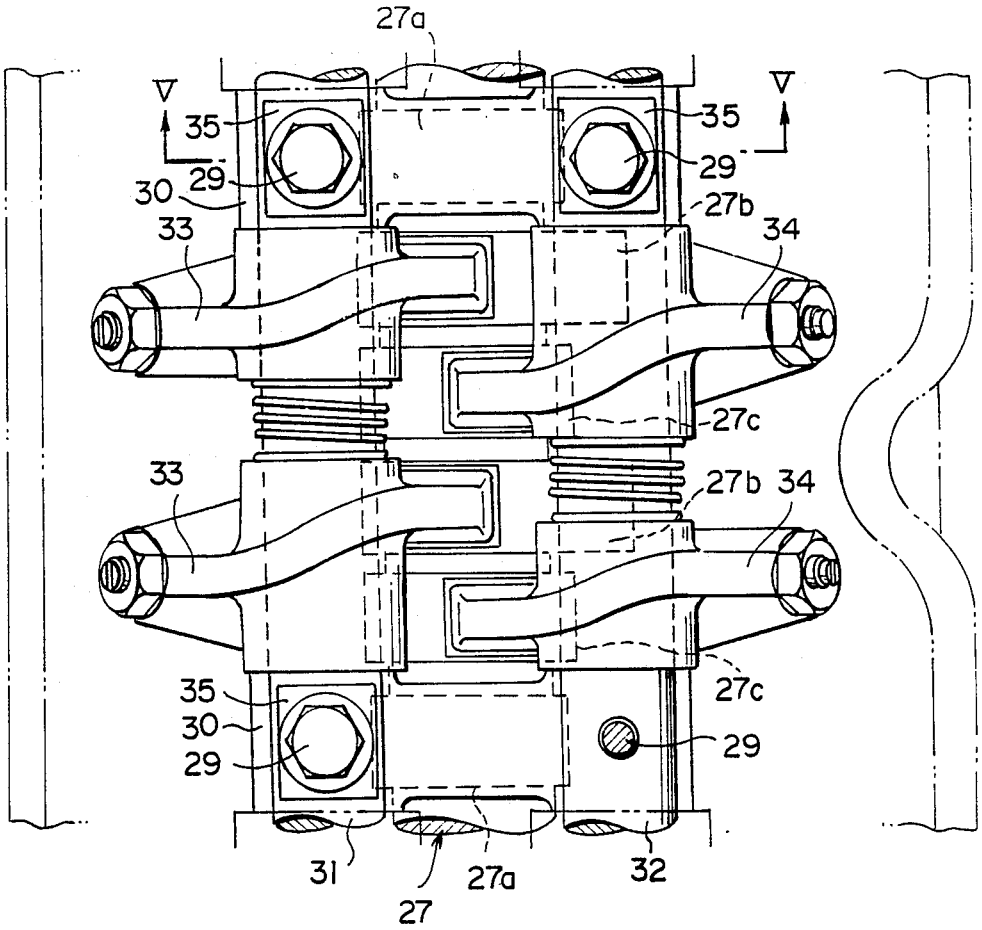
FIG. 4 is a plan view of the engine shown in FIG. 1.

A camshaft 27 extends in parallel to the crankshaft (not shown) on the upper surface 13*d* of the cylinder head 13 between the row of the intakes valves 19 and the row of the exhaust valves 20. As shown in FIGS. 1, 4 and 5, journals 27*a* of the camshaft 27 are received and supported for rotation in bearing openings defined upwardly opening semicircular recesses formed in bearing walls 28 provided at opposite ends of the cylinder head 13 and between adjacent cylinders, and downwardly opening semicircular recesses formed in bearing caps 30 which are fixedly mounted on the respective bearing walls 28 by bolts 29. The camshaft 27 is formed between each pair of adjacent journals 27*a* with a pair of cams 27*b* for operating the intake valves 19 and a pair of cams 27*c* for operating the exhaust valves 20, the cams 27*b* and 27*c* being positioned alternately. A pair of rocker arm shafts 31 and 32 extend in parallel to the camshaft 27 above the camshaft 27, one on either sides thereof. A pair of rocker arms 33 for operating the intake valves 19 for each cylinder are supported for pivotal movement on the rocker arm shaft 31 and a pair of rocker arms 34 for operating the exhaust valves 20 for each cylinder are supported for pivotal movement on the rocker arm shaft 32. The rocker arm shafts 31 and 32 are fixed on the bearing caps 30 by said bolts 29 by way of retainer members 35 with the lower halves of the rocker arm shafts 31 and 32 being respectively accommodated in semicircular recesses 30*a* formed on the upper surface of the bearing cap 30. The intake valves 19 and the exhaust valves 20 are opened and closed at respective predetermined times upon rotation of the camshaft 27 in the known manner.

Figure 6:
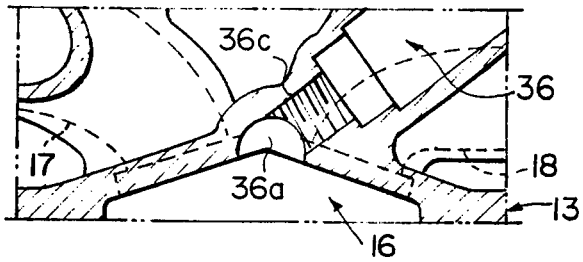
FIG. 6 is an enlarged cross sectional view showing a part of the cylinder head employed in the engine of FIG. 1 with the spark plug removed.

Spark plugs 37 are screwed into plug holes 36 formed in the cylinder head 13. Each plug hole 36 is obliquely formed between the exhaust ports 18 for each cylinder and extends to cross the valve stem 20*a* of the exhaust valves 20 (i.e., the plug hole 36 is inclined with respect to the horizon by an angle smaller than the angle by which the exhaust valve stems 20*a* are inclined with respect to the horizon) so that its inner end 36*a* opens at a position surrounded by the ends 17*a* and 18*a* of the intake ports 17 and the exhaust ports 18 or the center of the combustion chamber 16 and its outer end 36*b* opens at the corner of the cylinder head 13 between the upper surface 13*d* and the side 13*c* in which the outer ends 18*b* of the exhaust ports 18 open (as viewed from the side of the engine) and between the outer ends 18*b* of the exhaust ports 18 (as viewed in the crankshaft direction of the engine). This arrangement is advantageous in that since the plug hole 36 opens on the outer side of the exhaust valve driving mechanism 38 including said spring seat portions 24, the valve springs 26, the rocker arms 34 and the like, the spark plug 37 can be screwed into and removed from the plug hole 36 without interference with the camshaft 27, the exhaust valve driving mechanism 38 and the like. As best shown in FIG. 6, the inner end portion 36*a* of the plug hole 36 is enlarged to form a semi-spherical recess and the part of the plug hole 36 adjacent to the inner end 36*a* is threaded to form a female screw portion 36*c* with which the male screw portion 37*a* of the spark plug 37 is engaged. When the spark plug 37 is screwed into the plug hole 36, the igniting tip 37*b* of the spark plug 37 projects into the combustion chamber 16 from the semi-spherical inner end portion 36*a*. That is, a semi-spherical cavity is formed around the igniting tip 37*b* of the spark plug 37. This is advantageous in that the igniting tip 37*b* can be positioned remote from the recessed portion 13*a* of the cylinder block 13 defining the top wall of the combustion chamber 16, thereby preventing heat generated when the spark plug 37 is energized from being transmitted to the cylinder block 13, and that a sufficient amount of air-fuel mixture is provided around the igniting tip 37*b* of the spark plug 37 so that good flame growth at the beginning of ignition is assured. Since the spark plug 37 is positioned at a relatively small angle to the horizontal plane in this embodiment, if it were not for the semi-spherical cavity the igniting tip 37*b* would be positioned near the top wall of the combustion chamber 16 and accordingly the igniting tip 37*b* of the spark plug 37 would be robbed of heat by the top wall of the combustion chamber 16 and the amount of air-fuel mixture provided around the igniting tip 37*b* of the spark plug 37 would tend to be insufficient. Further, the plug hole 36 is enlarged in diameter at the outer end portion so that a tool can be applied to the hexagonal portion 37*c* of the spark plug 37.

As can be understood from FIG. 1, the exhaust port 18 has a bight portion 18*c* and the radius of curvature of the bight portion 18*c* is reduced by a limited amount so as not to adversely affect the flow of exhaust gas, thereby reducing the amount of overlap of the plug hole 36 with the bight portion 18*c* as seen from the front of the engine. Further, as can be understood from FIG. 2, the exhaust ports 18 are bent near the inner ends 18*a* thereof to diverge away from each other so as not to interfere with the plug hole 36 and are bent downstream of the plug hole 36 to converge toward each other. This arrangement contributes to reduction of the size of the engine 10 in the direction of the crankshaft. Further, by reducing the distance between the exhaust ports 18, the distance between head bolts 39 on the exhaust port side can be equalized to that between head bolts 40 on the intake port side and the head bolts 39 and 40 can be arranged at the respective corners of a square surrounding the combustion chamber 16, which is preferable for sealing the periphery of the combustion chamber 16.

Figure 7:
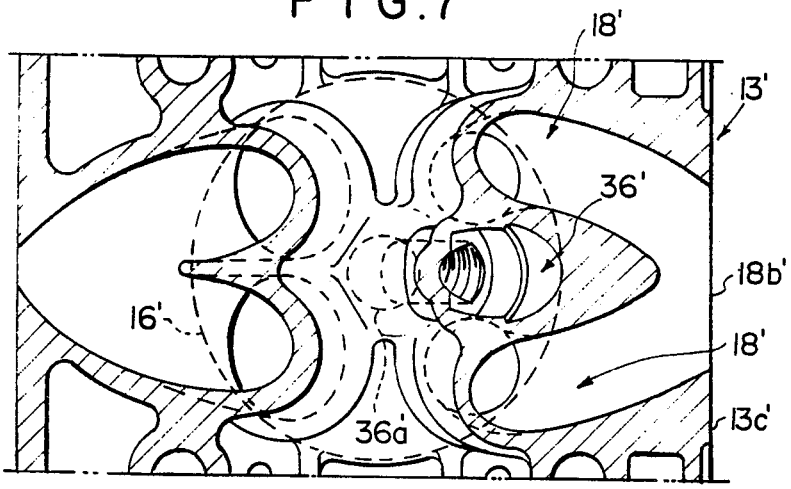
FIG. 7 is a cross-sectional view of a cylinder head employed in an engine in accordance with another embodiment of the present invention.
Figure 8:
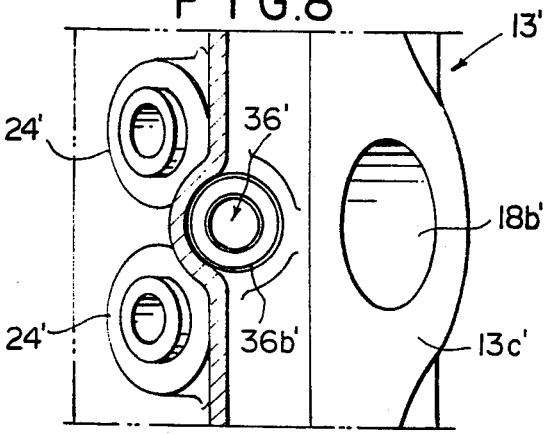
FIG. 8 is a fragmentary cross-sectional view of the cylinder head shown in FIG. 7.

In another embodiment of the present invention shown in FIGS. 7 and 8, the exhaust ports 18' merge with each other at a downstream side portion and open in the side 13*c'* of the cylinder head 13' as a single opening 18*b'*. The plug hole 36' is obliquely formed between the bifurcated portion of the exhaust ports 18' and the outer end 36*b'* opens between the opening 18*b'* and the spring seat portion 24' with the inner end 37*a'* opening at the center of the combustion chamber 16'. Substantially the same effects can be obtained in this embodiment as those in the preceding one.

Figure 9:
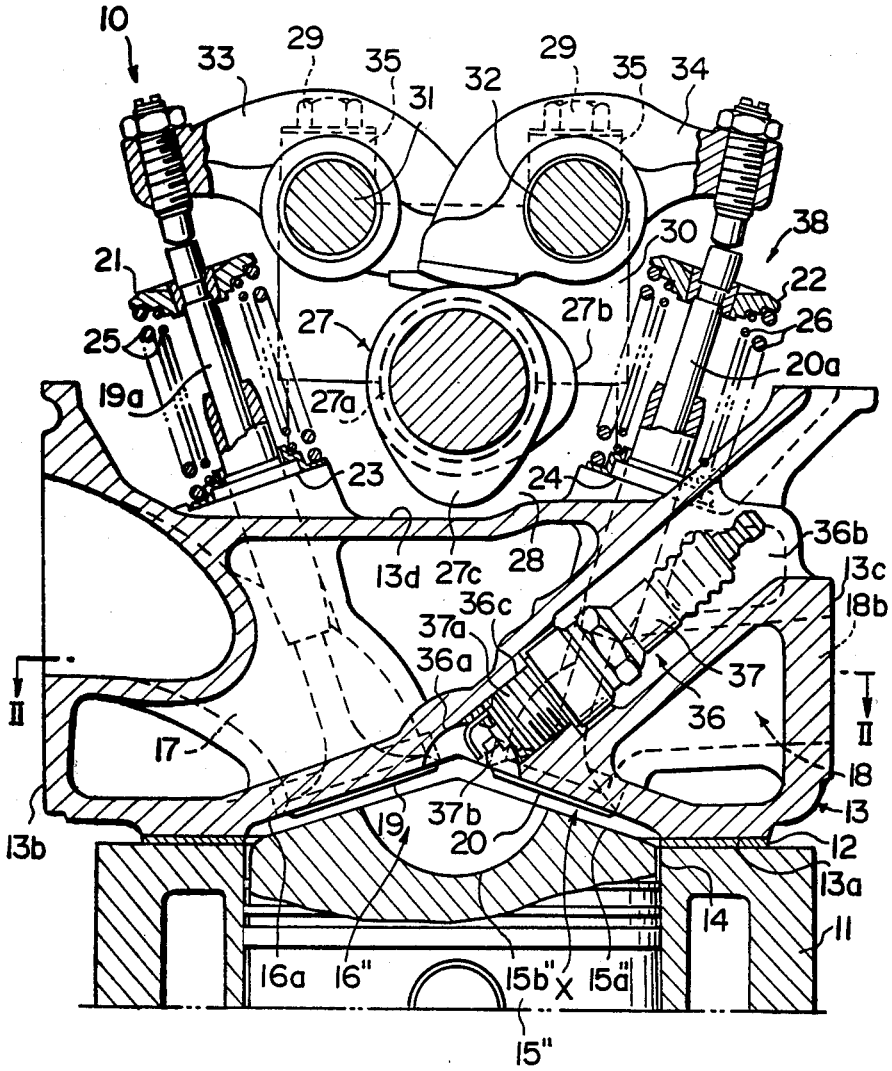
FIG. 9 is a fragmentary cross-sectional view of a single overhead camshaft four-valve engine in accordance with still another embodiment of the present invention.
Figure 10:
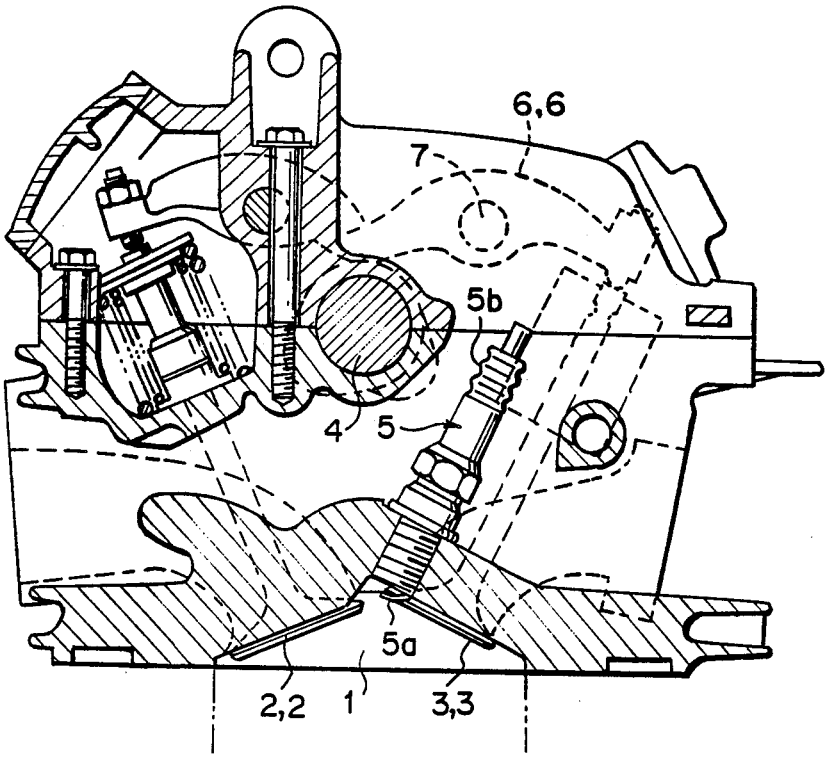
FIG. 10 PRIOR ART
FIG. 10 is a view similar to FIG. 1 but showing the engine in accordance with the prior art.
Figure 11:
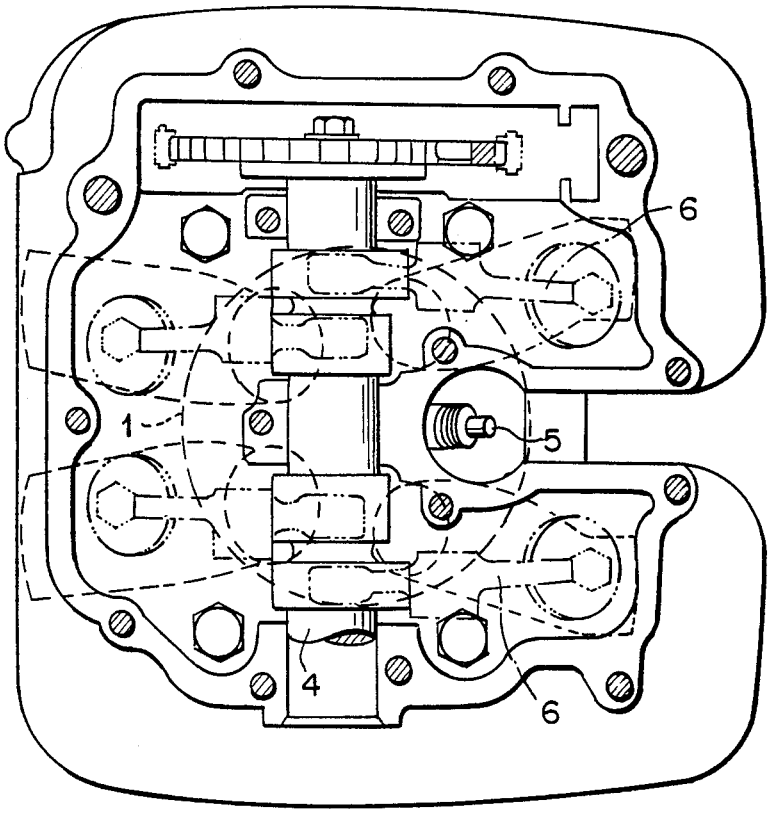
FIG. 11 PRIOR ART
FIG. 11 is a plan view of the engine shown in FIG. 10.

FIG. 9 shows a single overhead camshaft four-valve engine in accordance with still another embodiment of the present invention. The engine shown in FIG. 9 is similar to that shown in FIG. 1 except that the piston 15" has a pentroof type upper end surface 15*a"* conforming to the recessed portion of the cylinder head 13 and is provided with a recess 115*b* defining a combustion chamber 16", and accordingly, the parts analogous to the parts shown in FIG. 1 are given the same reference numerals. The igniting tip 37*b* of the spark plug 37 is positioned in the semi-spherical cavity formed by the inner end portion 36*a* of the plug hole 36. In this engine, a squish flow flowing into the recess 15*b"* of the piston 15" from the space between the upper end surface 15*a"* and the lower surface of the cylinder head 13 is generated when the piston 15" approaches the top dead center during the compression stroke. As is well known, the squish flow generally promotes mixing of air with fuel in the combustion chamber and growth of flame after ignition. However, when the igniting tip 37*b* of the plug 37 is in the squish flow and the flame is prematurely exposed to a strong flow of the air-fuel mixture, misfire is apt to occur. In this embodiment, the igniting tip 37*b* of the spark plug 37 is accommodated in the semi-spherical cavity formed by the inner end 36*a* of the plug hole 36, and accordingly the flame is not exposed to the squish flow immediately after ignition. Therefore, the air-fuel mixture can be positively ignited without misfire, and the flame can be well propagated by the squish flow.

Also in engines which are arranged to generate swirl of the air-fuel mixture in the combustion chamber, the semi-spherical cavity can prevent the flame from being prematurely exposed to the swirl of the air-fuel mixture. Though the shape of the cavity need not be limited to semi-spherical, the semi-spherical shape is preferred in that a cavity of sufficient volume can be ensured without interference with the valve seats for the intake valves and the exhaust valves.

We claim:

1. An internal combustion engine comprising a cylinder block having a plurality of cylinders in which a plurality of pistons are respectively slidably received, and a cylinder head fixedly mounted on the cylinder block to form a plurality of combustion chambers respectively with at least said plurality of pistons, each combustion chamber being provided with a pair of intake ports each of which is opened and closed by an intake valve, a pair of exhaust ports each of which is opened and closed by an exhaust valve and a means for forming flame in the combustion chamber receiving hole into which means for forming flame in the combustion chamber is inserted, a single overhead camshaft for driving the intake and exhaust valves in which said exhaust valves for opening and closing the pair of exhaust ports for each combustion chamber are respectively driven by rocker arms which are supported on a first rocker arm shaft and in which said intake valves for opening and closing the pair of intake ports for each combustion chamber are respectively driven by rocker arms which are supported on a second rocker arm shaft, where each said means for forming flame in the combustion chamber receiving hole is obliquely formed in the cylinder head between a pair of exhaust ports associated with a combustion chamber so that the inner end of each means for forming flame in the combustion chamber receiving hole opens to the combustion chamber substantially in the middle thereof and the outer end of the same opens toward the outside of the cylinder head at a portion between, as viewed in the crankshaft direction of the engine, the outer end of the pair of exhaust ports and the portion of the cylinder head at which the valve spring seats for the exhaust valves are formed, where said pair of exhaust ports are provided with bight portions at which they are bent to diverge away from each other at a portion near the inner ends thereof, where said means for forming flame in the combustion chamber receiving hole passes between the bight portions of the exhaust ports, and where head bolts for securing the cylinder head to the cylinder block are disposed between the exhaust ports of adjacent combustion chambers, the exhaust ports for each combustion chamber being further bent toward each other downstream of the means for forming flame in the combustion chamber receiving hole and opening to the side of the cylinder block between an adjacent pair of head bolts.

2. An internal combustion engine as defined in claim 1 in which said pair of exhaust ports for each combustion chamber separately open to the side of the cylinder block.

3. An internal combustion engine as defined in claim 1 in which said pair of exhaust ports for each combustion chamber are combined together near the side of the cylinder block and open in a single opening.

4. An internal combustion engine as defined in claim 1 in which said inner end of the means for forming flame in the combustion chamber receiving hole is enlarged to form a semi-spherical cavity.

5. An internal combustion engine as defined in claim 4 in which each combustion chamber is of a pent-roof type.

6. An internal combustion engine as defined in claim 4 in which the inner tip of the means for forming flame in the combustion chamber is accommodated in the semi-spherical cavity.

7. An internal combustion engine as defined in claim 1 in which said exhaust valves for opening and closing the pair of exhaust ports for each combustion chamber have valve stems extending in parallel to each other.

8. An internal combustion engine comprising a cylinder block having a plurality of cylinders in which a plurality of pistons are respectively slidably received, and a cylinder head fixedly mounted on the cylinder block to form a plurality of combustion chambers respectively with at least said plurality of pistons, each combustion chamber being provided with a pair of intake ports each of which is opened and closed by an intake valve having a valve stem, a pair of exhaust ports each of which is opened and closed by an exhaust valve having a valve stem and a means for forming the combustion chamber receiving hole into which means for forming flame in the combustion chamber is inserted, a single overhead camshaft for driving the intake and exhaust valves in which said exhaust valves for opening and closing the pair of exhaust ports for each combustion chamber are respectively driven by rocker arms which are supported on a first rocker arm shaft and in which said intake valves for opening and closing the pair of intake ports for each combustion chamber are respectively driven by rocker arms which are supported on a second rocker arm shaft, where each said means for forming flame in the combustion chamber receiving hole is obliquely formed in the cylinder head between a pair of exhaust ports associated with a combustion chamber so that the inner end of each means for forming flame in the combustion chamber receiving hole opens to the combustion chamber at a portion surrounded by the openings of the intake and exhaust ports to the combustion chamber and the longitudinal axis thereof is inclined with respect to the axis of the cylinder by an angle larger than the angle by which the valve stems of the exhaust valves are inclined with respect to the same, whereby the means for forming flame in the combustion chamber receiving hole extends between the valve stems of the exhaust valves, where said pair of exhaust ports are provided with bight portions at which they are bent to diverge away from each other at a portion near the inner ends thereof, where said means for forming flame in the combustion chamber receiving hole passes between the bight portions of the exhaust ports, and where head bolts for securing the cylinder head to the cylinder block are disposed between the exhaust ports of adjacent combustion chambers, the exhaust ports for each combustion chamber being further bent toward each other downstream of the means for forming flame in the combustion chamber receiving hole and opening to the side of the cylinder block between an adjacent pair of head bolts.

9. An internal combustion engine as defined in claim 8 comprising a single overhead camshaft for driving the intake and exhaust valves.

* * * * *